US010866000B2

(12) United States Patent
Jung et al.

(10) Patent No.: US 10,866,000 B2
(45) Date of Patent: Dec. 15, 2020

(54) AIR CONDITIONER

(71) Applicant: SAMSUNG ELECTRONICS CO., LTD., Suwon-si, Gyeonggi-do (KR)

(72) Inventors: Chang-woo Jung, Suwon-si (KR); Jin-Gyun Kim, Seongnam-si (KR); Yeon-seob Yun, Hwaseong-si (KR); Weon Seok Choi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 96 days.

(21) Appl. No.: 16/067,325

(22) PCT Filed: Dec. 29, 2016

(86) PCT No.: PCT/KR2016/015505
§ 371 (c)(1),
(2) Date: Jun. 29, 2018

(87) PCT Pub. No.: WO2017/119672
PCT Pub. Date: Jul. 13, 2017

(65) Prior Publication Data

US 2019/0017711 A1 Jan. 17, 2019

(30) Foreign Application Priority Data

Jan. 7, 2016 (KR) ..... 10-2016-0002105

(51) Int. Cl.
*F24F 1/00* (2019.01)
*F24F 1/0014* (2019.01)
(Continued)

(52) U.S. Cl.
CPC ..... *F24F 1/0014* (2013.01); *F24F 11/745* (2018.01); *F24F 11/79* (2018.01);
(Continued)

(58) Field of Classification Search
CPC ..... F24F 11/745; F24F 11/79; F24F 11/755; F24F 11/77; F24F 13/08; F24F 1/0014; F24F 11/74
(Continued)

(56) References Cited

U.S. PATENT DOCUMENTS 5,187,949 A * 2/1993 Jung-Il ..... F24F 1/0007 62/411
2004/0244391 A1* 12/2004 Kouno ..... F24F 1/0011 62/176.1
(Continued)

FOREIGN PATENT DOCUMENTS

CN 101105307 1/2008
CN 103017313 1/2015
(Continued)

OTHER PUBLICATIONS

Extended European Search Report dated Nov. 6, 2018 from European Patent Application No. 16884055.1, 9 pages.
(Continued)

*Primary Examiner* — Tho V Duong
(74) *Attorney, Agent, or Firm* — Staas & Halsey LLP

(57) ABSTRACT

Disclosed herein is an air conditioner. The air conditioner includes a housing having an inlet port, a heat exchanger configured to exchange heat with air flowing in through the inlet port, a blowing unit configured to circulate air into or out of the housing, and a discharge unit rotatably provided relative to the housing, the discharge unit having a first outlet port formed in a portion of the outer circumferential surface to discharge the heat-exchanged air and a second outlet port formed in another portion of the outer circumferential surface to discharge the heat-exchanged air at different speed from the air discharged from the first outlet port.

15 Claims, 18 Drawing Sheets

(51) Int. Cl.

| | |
|---|---|
| ***F24F 13/08*** | (2006.01) |
| ***F24F 11/74*** | (2018.01) |
| ***F24F 11/79*** | (2018.01) |
| *F24F 13/10* | (2006.01) |

(52) U.S. Cl.
CPC ..... *F24F 13/08* (2013.01); *F24F 11/74* (2018.01); *F24F 13/10* (2013.01)

(58) Field of Classification Search
USPC ..... 165/248
See application file for complete search history.

(56) References Cited

U.S. PATENT DOCUMENTS

| | | | | |
|---|---|---|---|---|
| 2013/0153173 | A1* | 6/2013 | Nakamura | F24F 1/0033 165/96 |
| 2015/0087219 | A1* | 3/2015 | Yasutomi | F24F 1/0057 454/256 |

FOREIGN PATENT DOCUMENTS

| | | | | |
|---|---|---|---|---|
| CN | 104764100 | | 7/2015 | |
| CN | 104315693 | | 2/2017 | |
| JP | 4265046 | | 2/2009 | |
| JP | 2014-126308 | | 7/2014 | |
| KR | 1999-0039407 | | 6/1999 | |
| KR | 10-0755139 | | 9/2007 | |
| KR | 10-0779538 | | 11/2007 | |
| KR | 10-2008-0013393 | | 2/2008 | |
| KR | 10-2008-0013397 | | 2/2008 | |
| KR | 20-0443817 | | 12/2008 | |
| KR | 10-2013-0054037 | | 5/2013 | |
| KR | 10-2014-0011716 | | 1/2014 | |
| KR | 10-2014-0046176 | | 4/2014 | |
| KR | 10-1516365 | | 4/2015 | |
| KR | 10-2015-0085218 | | 7/2015 | |
| WO | WO-0204874 | A1 * | 1/2002 | F24F 11/79 |

OTHER PUBLICATIONS

International Search Report, PCT/ISA/210, dated Apr. 13, 2017, in corresponding International Patent Application No. PCT/KR2016/015505.

Written Opinion, PCT/ISA/237, dated Apr. 13, 2017, in corresponding International Patent Application No. PCT/KR2016/015505.

Chinese Office Action dated Mar. 17, 2020 from Chinese Application No. 201680078211.4, 18 pages.

* cited by examiner

【Fig. 1】
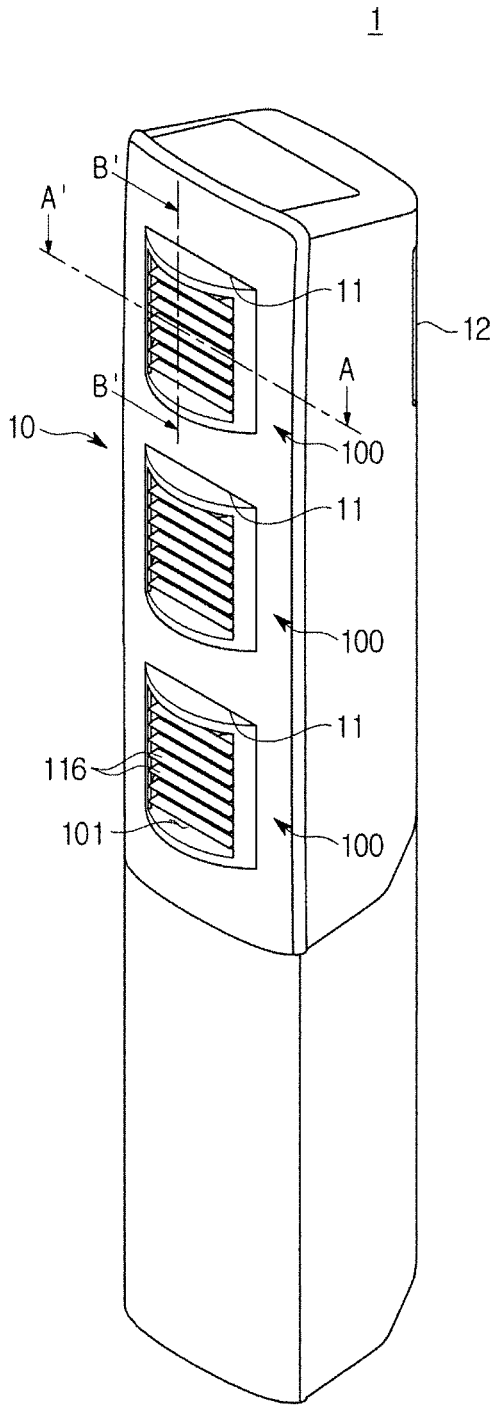

【Fig. 2】
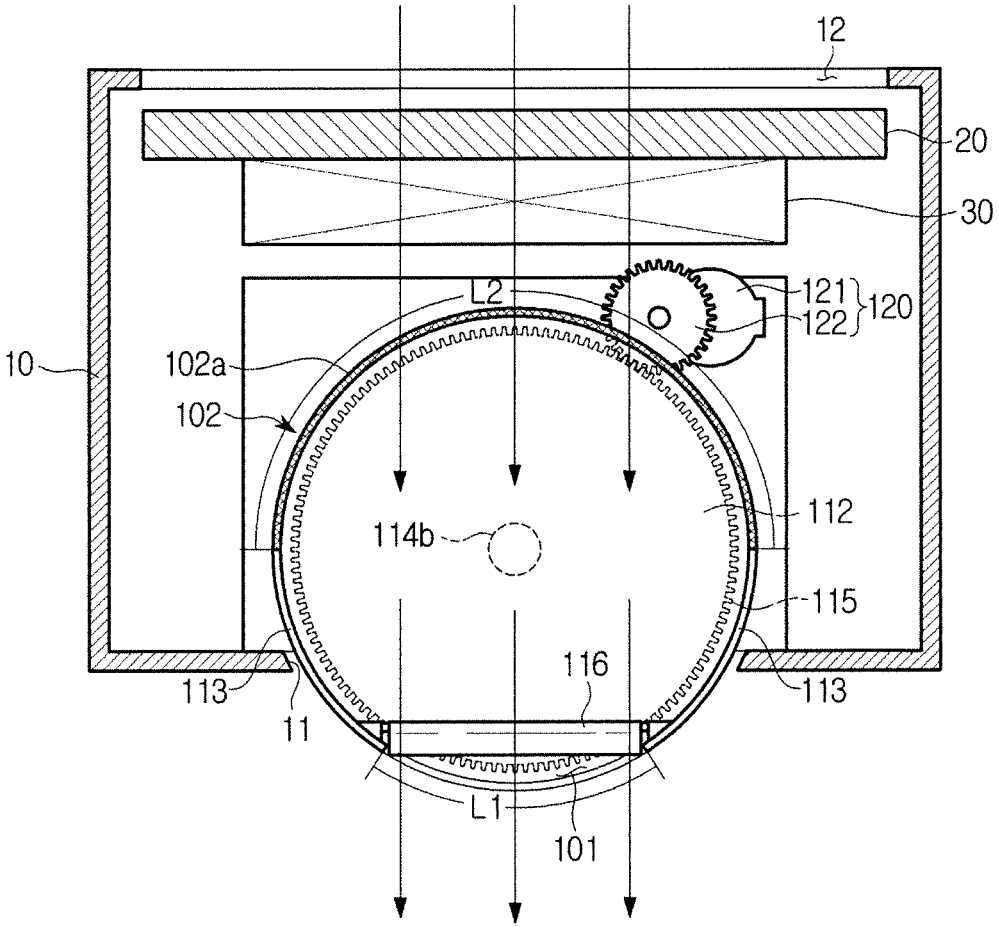

【Fig. 3】
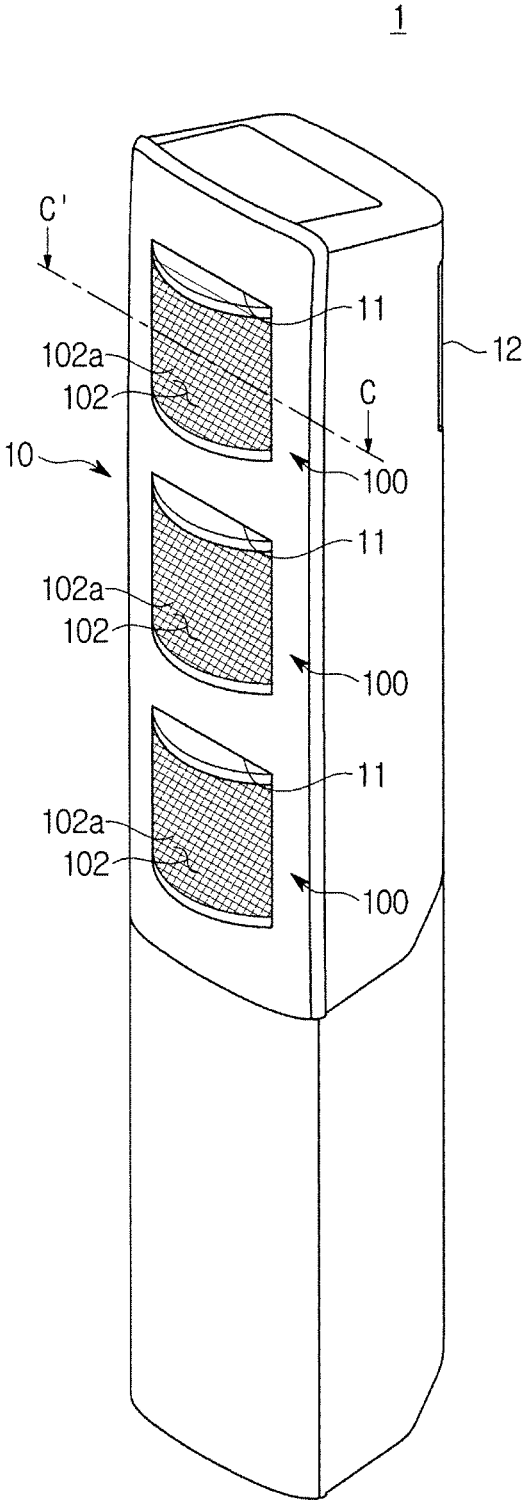

【Fig. 4】
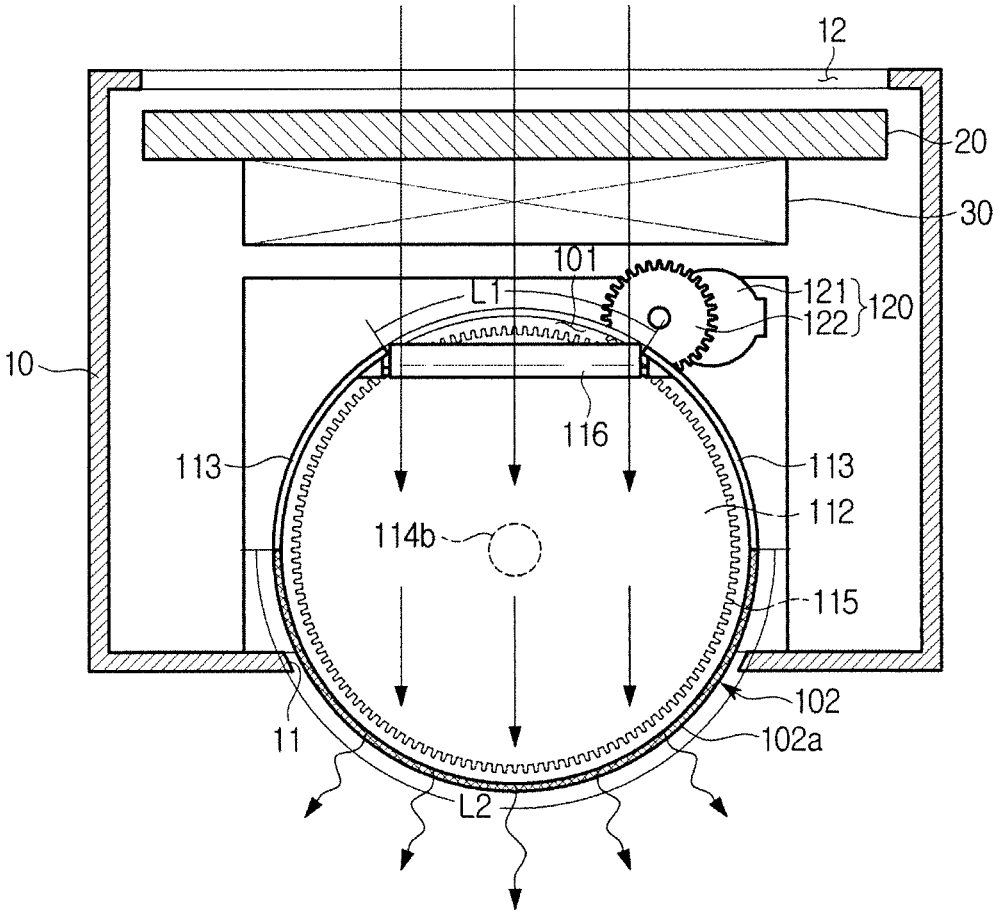

【Fig. 5】
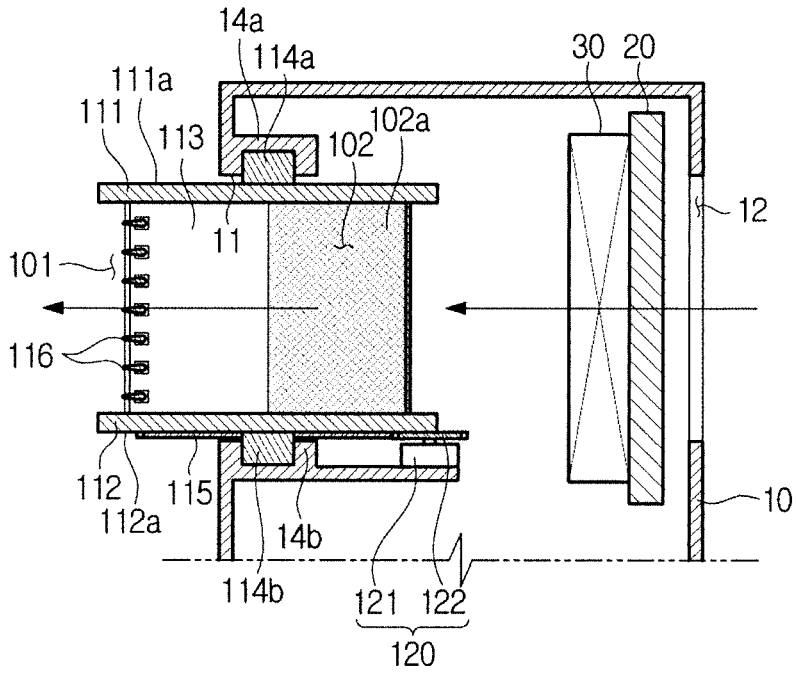

【Fig. 6】
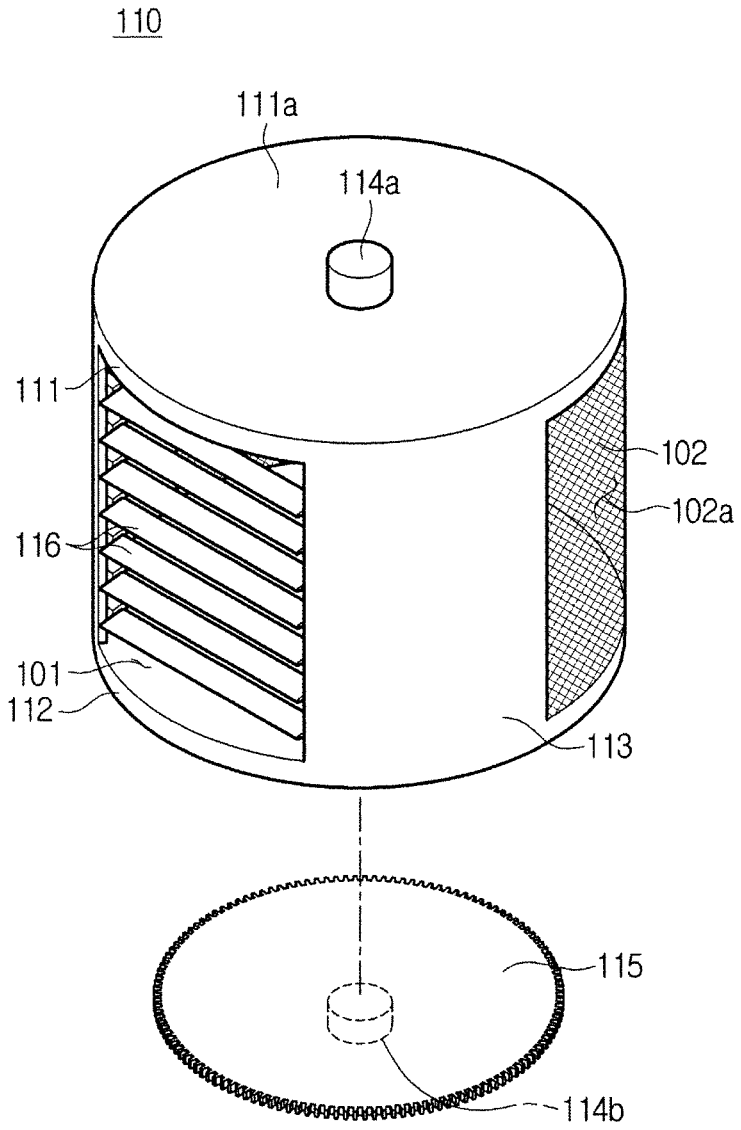

【Fig. 7】
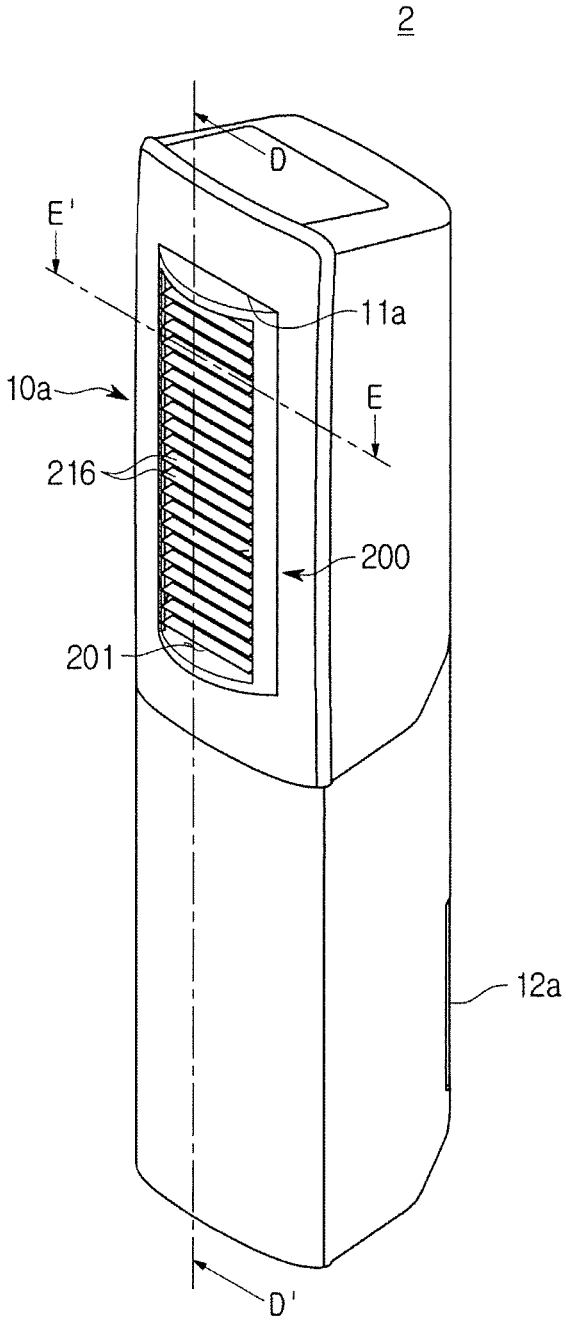

【Fig. 8】
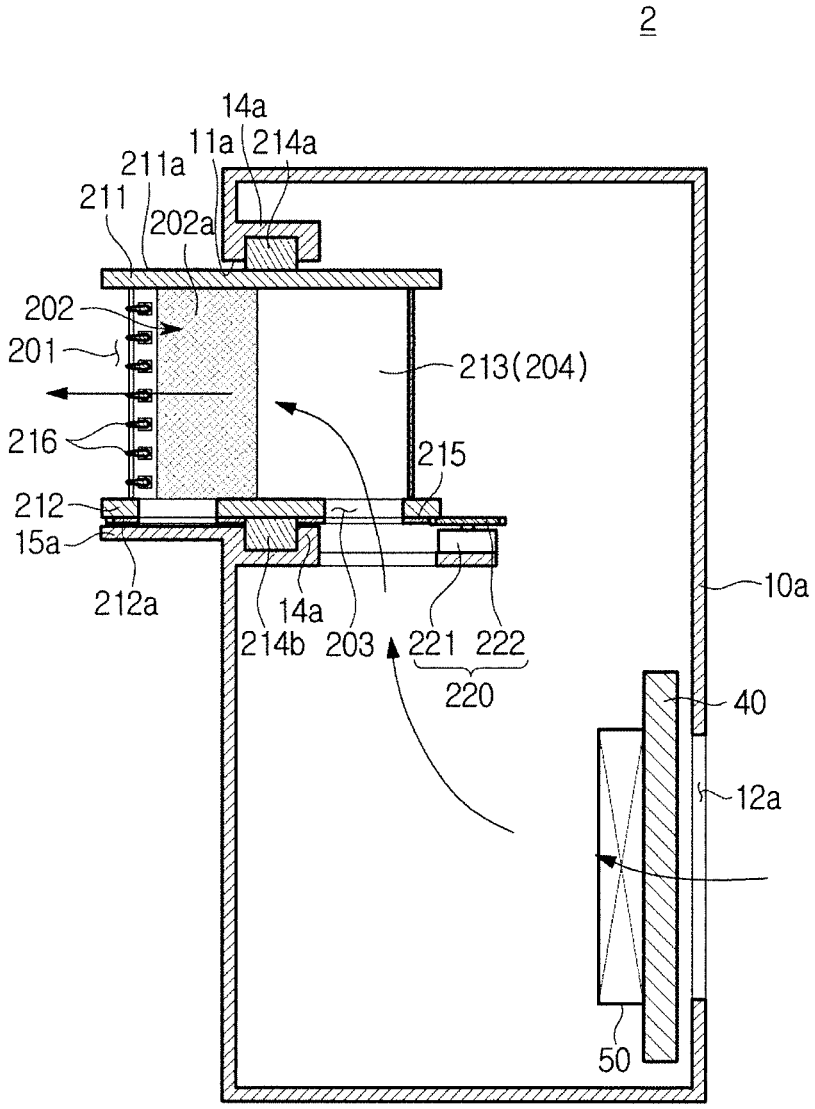

【Fig. 9】
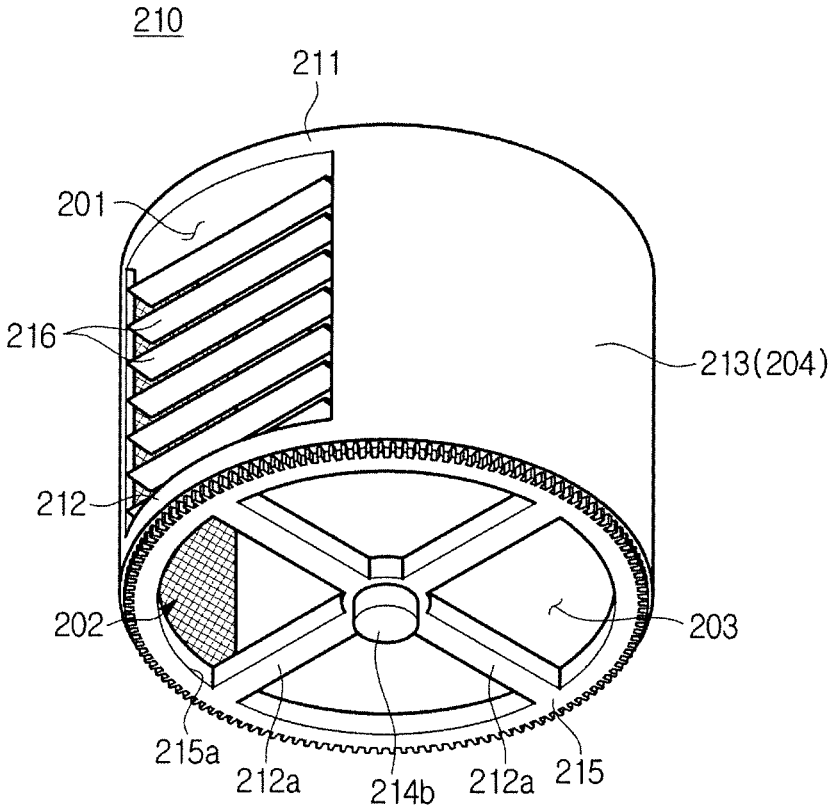

【Fig. 10】
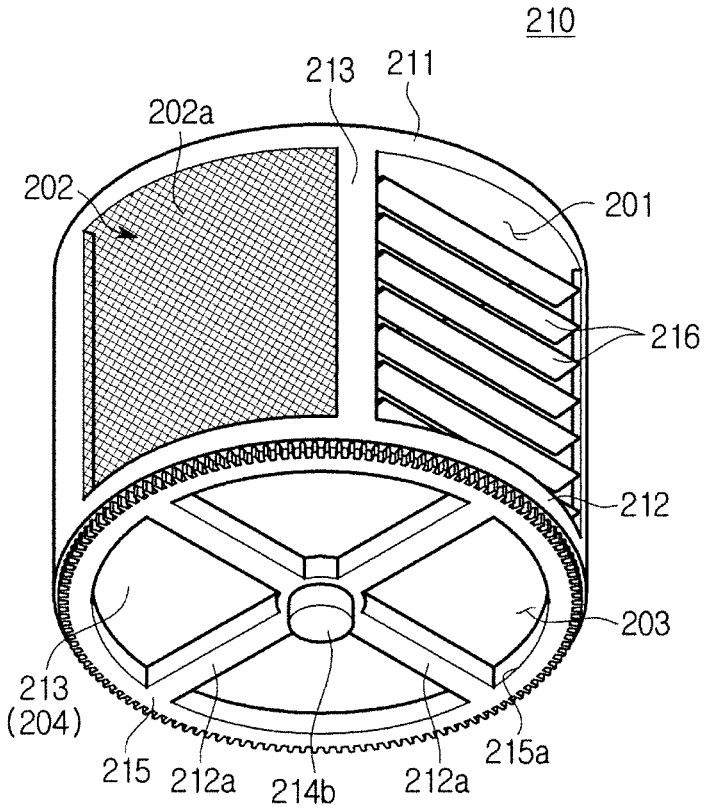

【Fig. 11】
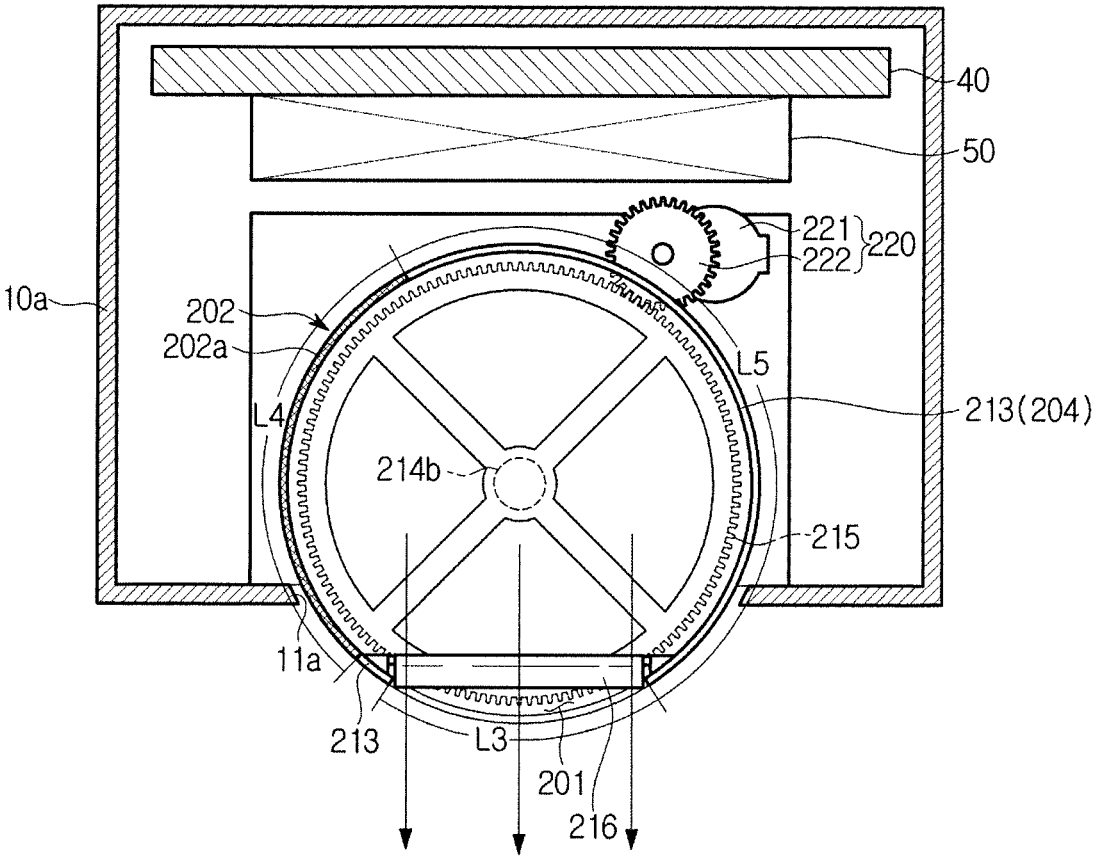

【Fig. 12】
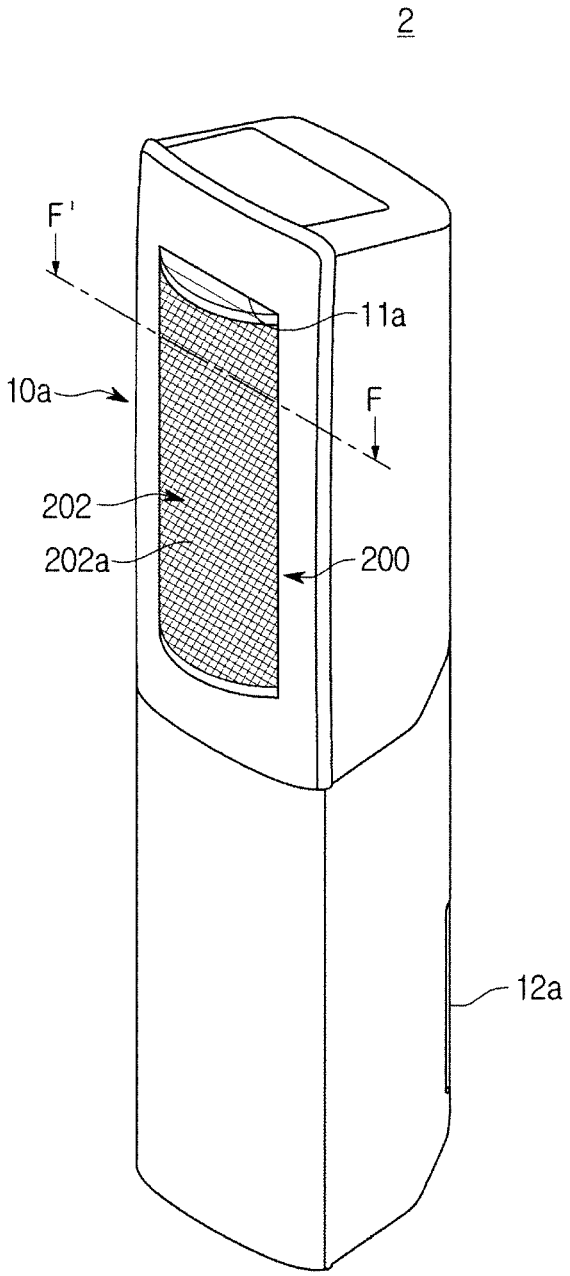

【Fig. 13】
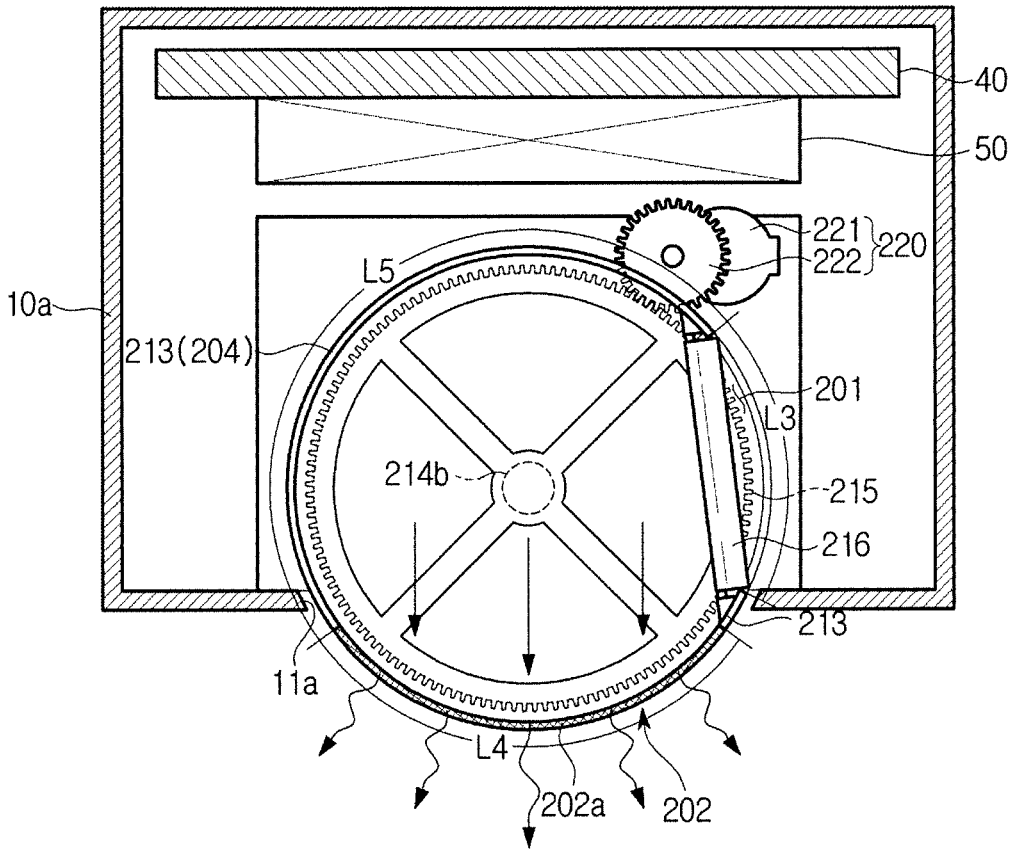

【Fig. 14】
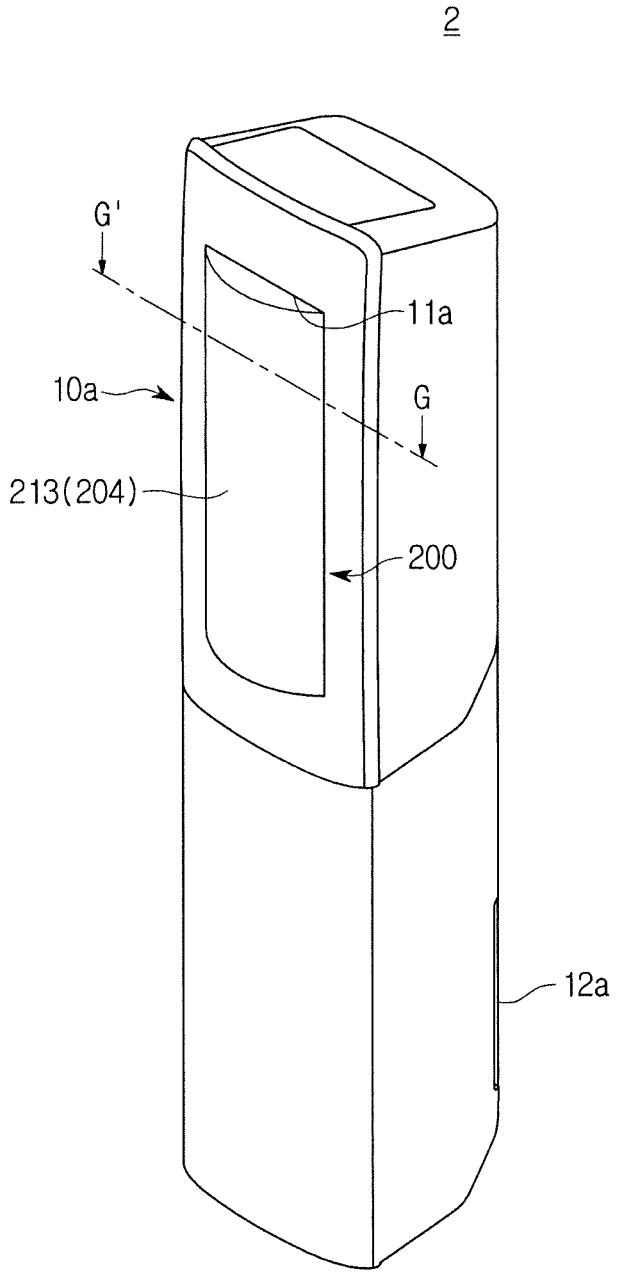

【Fig. 15】
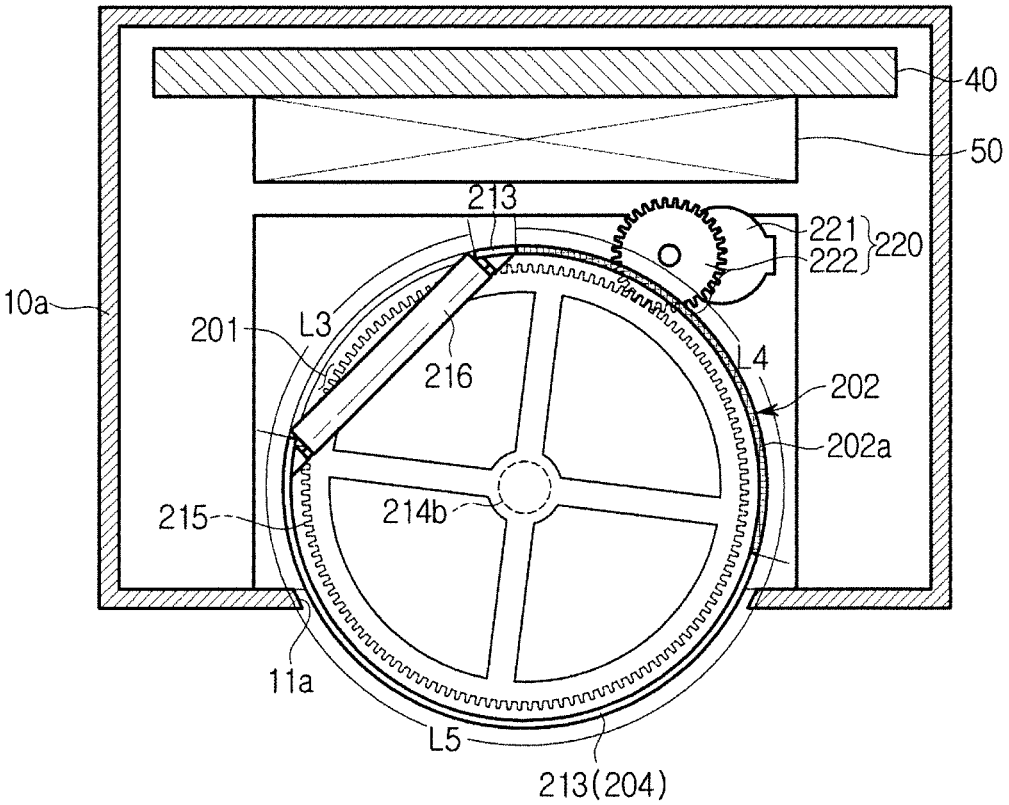

【Fig. 16】
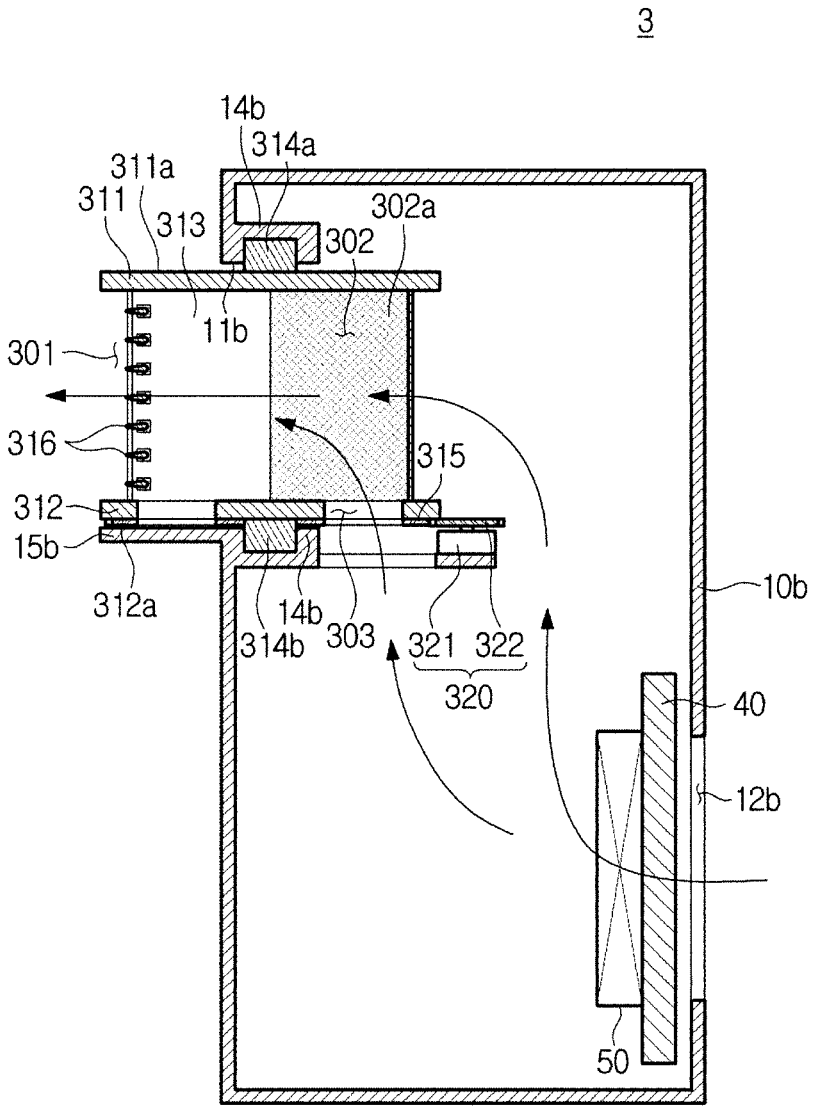

【Fig. 17】
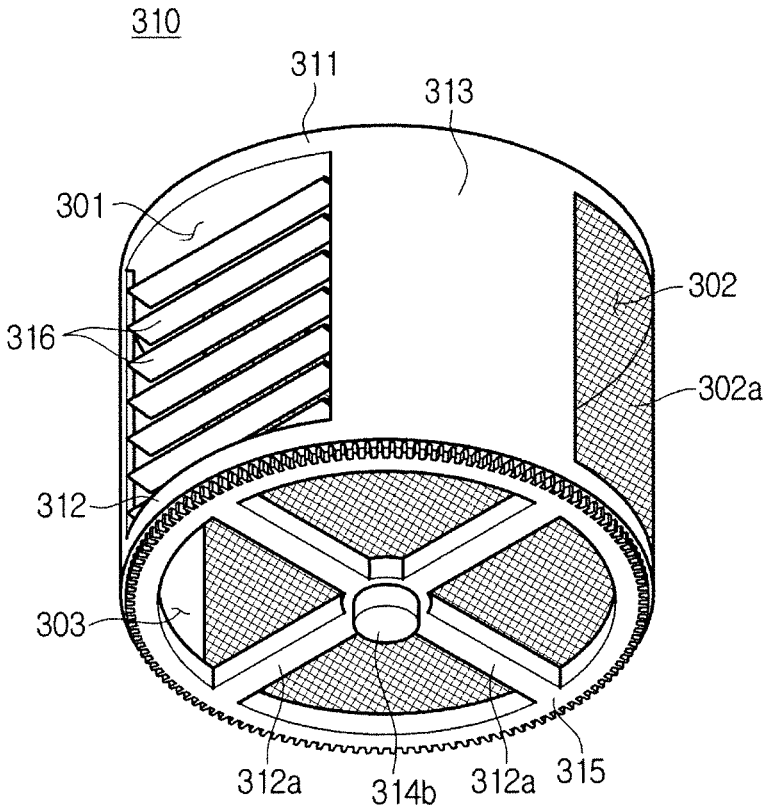

【Fig. 18】
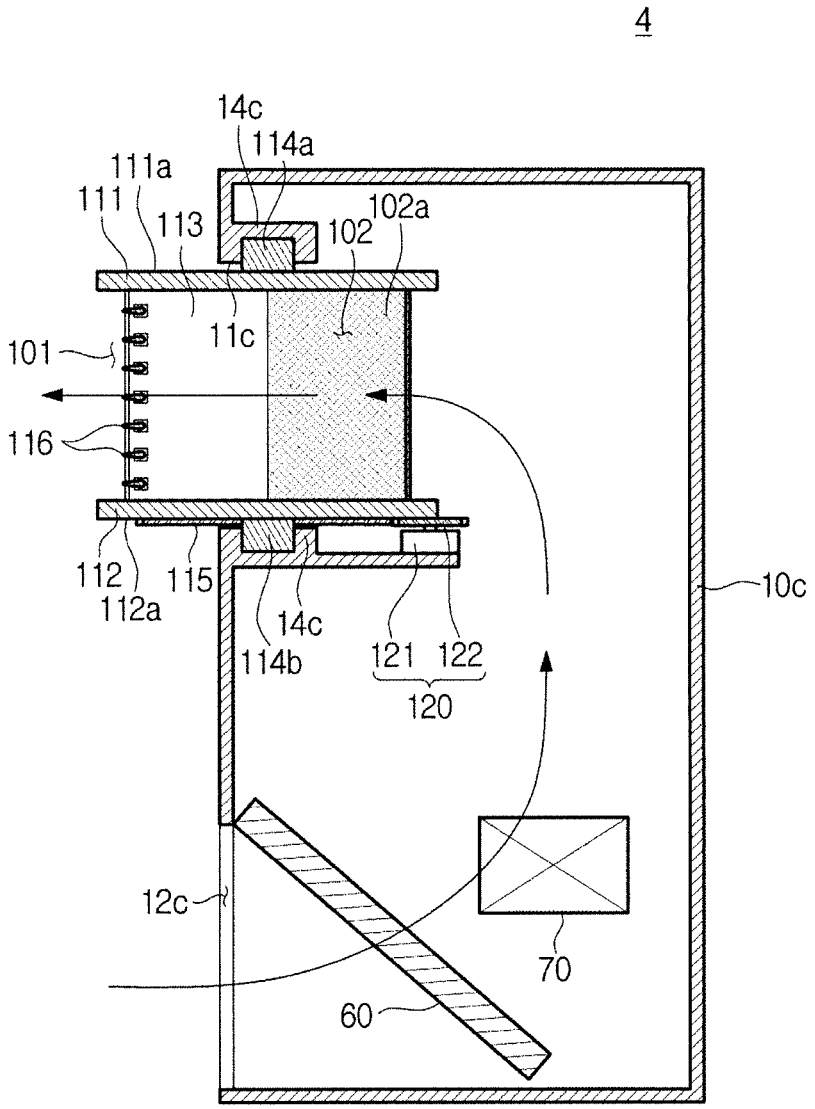

AIR CONDITIONER

CROSS REFERENCE TO RELATED APPLICATIONS

This application is a U.S. National Stage Application, which claims the benefit under 35 U.S.C. § 371 of International Patent Application No. PCT/KR2016/015505 filed on Dec. 29, 2016, which claims the foreign priority benefit under 35 U.S.C. § 119 of Korean Patent Application No. 10-2016-0002105, filed Jan. 7, 2016, the contents of which are incorporated herein by reference.

TECHNICAL FIELD

The present disclosure relates to an air conditioner, and more particularly, to an air conditioner that varies air discharging.

BACKGROUND ART

Generally, an air conditioner is a device to control temperature, humidity, airflow, air distribution, etc., to be suitable for human activities and at the same time, remove impurities including the dust from the air by using the refrigeration cycle. Compressors, condensers, evaporators, blower fans, etc, are the main components of the refrigeration cycle.

The air conditioner can be divided into a split type air conditioner in which an indoor unit and an outdoor unit are separated and a packaged type air conditioner in which an indoor unit and an outdoor unit are installed together in a single cabinet. The indoor unit of the split type air conditioner includes a heat exchanger for exchanging heat with the air sucked into the panel, and a blower fan for sucking indoor air into the panel and blowing the introduced air back into the room.

The conventional air conditioner indoor unit minimizes the heat exchanger and increases the RPM of the blower fan to maximize wind speed and airflow. As a result, a discharge temperature is lowered, and the discharge air is discharged into the indoor space while forming a narrow and long flow path.

When the discharge air directly touches the user, the user can feel cold and unpleasant, and on the contrary, when the discharge air does not directly touch the user, the user may feel hot and unpleasant.

In addition, when the RPM of the blower fan is increased to realize high wind speed, the noise increases. In the case of a radiator air conditioner that does air conditioning without a blower fan, a large panel is required to achieve the same capability as the air conditioner using the blower fan. Furthermore, it suffers from very slow cooling rate and high costs of installation.

DISCLOSURE

Technical Problem

One aspect of the present disclosure discloses an air conditioner having various air discharge methods.

Another aspect of the present disclosure discloses an air conditioner capable of cooling and/or heating the room with a minimum wind speed at which the user feels pleasant.

Technical Solution

In accordance with an aspect of the present disclosure, an air conditioner includes a housing having an inlet port, a heat exchanger configured to exchange heat with air sucked in through the inlet port, a blowing unit configured to circulate air into or out of the housing, and a discharge unit rotatably provided relative to the housing, the discharge unit having a first outlet port formed in a portion of the outer circumferential surface to discharge the heat-exchanged air and a second outlet port formed in another portion of the outer circumferential surface to discharge the heat-exchanged air at different speed from the air discharged from the first outlet port.

The discharge unit may selectively discharge air through the first outlet port or the second outlet port as the discharge unit rotates relative to the housing.

The first outlet port and the second outlet port may be each formed to have a predetermined length along an outer circumferential direction of the discharge unit.

The second outlet port may be formed to have longer length than the length of the first outlet port along the outer circumferential direction.

The second outlet port may include a plurality of discharge holes.

The discharge unit may be configured such that heat-exchanged air flows into the first outlet port and is discharged to the second outlet port, or heat-exchanged air flows into the second outlet port and is discharge to the first outlet port.

The discharge unit may include a discharge unit opening formed on a surface perpendicular to a rotation axis so that heat-exchanged air flows in the direction of the rotation axis.

The discharge unit may be configured to force air to flow in the direction of a rotational axis and discharge in a radial direction.

The second outlet port may be configured to discharge air at a speed lower than the air discharged from the first outlet port.

The discharge unit may include at least one blade arranged adjacent to the first outlet port.

The air conditioner may further include a discharge unit driving part to rotate the discharge unit.

The discharge unit driving part may include a motor.

The discharge unit may be provided in the plural.

The blowing unit may be arranged behind the discharge unit and may be configured to blow air flowing into the housing to a front side where the discharge unit is located.

The blowing unit may be arranged below the discharge unit and may be configured to blow air flowing into the housing to an upper side where the discharge unit is located.

In accordance with another aspect of the present disclosure, an air conditioner includes a housing having an inlet port, a heat exchanger configured to heat-exchange air introduced from the inlet port, a blowing unit configured to circulate air into or out of the housing, and a discharge unit in which a discharge unit opening through which heat exchanged air flows is formed on a lower surface and in which a first outlet port and a second outlet port are formed along the outer periphery, respectively, and the first outlet port and the second outlet port provided to respectively discharge air at different speeds, wherein the second outlet port includes a plurality of discharge holes.

The discharge unit may be rotatably coupled to the housing, and may selectively communicate the first outlet port and the second outlet port with the outside as the discharge unit rotates about the housing.

The first outlet port may be provided such that air discharged through the first outlet port is discharged at a higher speed than air discharged through the second outlet port.

In accordance with still another aspect of the present disclosure, an air conditioner includes a housing, a heat exchanger configured to heat-exchange air introduced into the housing, and a cylindrical discharge unit rotatably coupled to the housing and having a first outlet port and a second outlet port provided to discharge heat-exchanged air and having a predetermined length along the outer circumference, wherein the discharge unit may selectively communicate the first outlet port and the second outlet port with the outside as the discharge unit rotates with respect to the housing.

The discharge unit may include a discharge unit opening through which air flows in a direction of a rotation axis.

Advantageous Effects

According to an embodiment of the present disclosure, an air conditioner is capable of discharging the heat-exchanged air at different wind speeds.

According to another embodiment of the present disclosure, an air conditioner is provided with a discharge unit having various outlet ports capable of discharging air at different speeds, so that it may discharge various air currents by rotation of the discharge unit.

According to another embodiment of the present disclosure, the air conditioner may cool and/or heat the indoor space without blowing the heat-exchanged air directly to the user, thereby improving the satisfaction of the user.

DESCRIPTION OF DRAWINGS

FIG. 1 is a view showing an air conditioner according to an embodiment of the present disclosure;

FIG. 2 is a view schematically showing a cross-section taken along the line A-A' shown in FIG. 1;

FIG. 3 is a view showing another operating state of the air conditioner shown in FIG. 1;

FIG. 4 is a view schematically showing a cross-section taken along the line C-C' shown in FIG. 1;

FIG. 5 is a view schematically showing a cross-section taken along the line B-B' shown in FIG. 1;

FIG. 6 is a view showing a discharge unit body of the air conditioner shown in FIG. 1;

FIG. 7 is a view showing an air conditioner according to another embodiment of the present disclosure;

FIG. 8 is a view schematically showing a cross-section taken along the line D-D' shown in FIG. 7;

FIGS. 9 and 10 are views showing a discharge unit body of the air conditioner shown in FIG. 7;

FIG. 11 is a view schematically showing a cross-section taken along the line E-E' shown in FIG. 7;

FIG. 12 is a view showing another operating state of the air conditioner shown in FIG. 7;

FIG. 13 is a view schematically showing a cross-section taken along the line F-F' shown in FIG. 12;

FIG. 14 is a view showing another operating state of the air conditioner shown in FIG. 7;

FIG. 15 is a view schematically showing a cross-section taken along the line G-G' shown in FIG. 14;

FIG. 16 is a cross-sectional view showing an air conditioner according to still another embodiment of the present disclosure.

FIG. 17 is a view showing a discharge unit body of the air conditioner shown in FIGS. 16; and FIG. 18 is a cross-sectional view showing an air conditioner according to still another embodiment of the present disclosure.

MODES OF THE INVENTION

Embodiments described herein and configurations illustrated in the drawings are merely preferred embodiments of the present disclosure, and various modified embodiments that are capable of substituting the embodiments and the drawings of the present specification may exist at the time of applying the present application.

Also, like reference numerals or symbols given in each drawing of the present specification represent parts or elements that perform substantially the same functions.

Also, the terms used herein are used to describe the embodiments and are not intended to restrict and/or limit the present disclosure. A singular expression includes a plural expression unless clearly defined otherwise in the context. The terms such as "include" or "have" used herein are to designate that a characteristic, a number, a step, an operation, an element, a part, or combinations thereof exist, and do not preclude in advance the existence of or the possibility of adding one or more other characteristics, numbers, steps, operations, elements, parts, or combinations thereof.

Also, the terms including ordinals such as "first," "second," and the like used herein may be used to describe various elements, but the elements are not limited by the terms, and the terms are used to only distinguish one element from another element. For example, a first element may be referred to as a second element while not departing from the scope of the present disclosure, and likewise, a second element may also be referred to as a first element. The term "and/or" includes a combination of a plurality of related described items or any one item among the plurality of related described items.

Meanwhile, the terms used in the description below such as "front end," "rear end," "upper portion," "lower portion," "upper end," and "lower end" are defined on the basis of the drawings, and a shape and a position of each element are not limited by the terms.

Hereinafter, embodiments according to the present disclosure will be described in detail with reference to the accompanying drawings.

A refrigeration cycle constituting an air conditioner consists of a compressor, a condenser, an expansion valve, and an evaporator. The refrigeration cycle performs a series of processes consisting of compression-condensation-expansion-evaporation, and after the high-temperature air exchanges heat with the low-temperature refrigerant, the low-temperature air is supplied to the room.

The compressor compresses and discharges the refrigerant gas in a state of high temperature and high pressure, and the discharged refrigerant gas flows into the condenser. The condenser condenses the compressed refrigerant into a liquid phase and releases heat to the surroundings through the condensation process. The expansion valve expands the high-temperature and high-pressure liquid refrigerant condensed in the condenser into a low pressure liquid refrigerant. The evaporator evaporates the refrigerant expanded by the expansion valve. The evaporator uses the latent heat of evaporation of the refrigerant to attain the refrigerating effect by heat exchange with the object to be cooled, and returns the refrigerant gas at low temperature and low pressure to the compressor. This cycle may control the air temperature of the indoor space.

The outdoor unit of the air conditioner refers to a part including the compressor and outdoor heat exchanger of the refrigeration cycle. The expansion valve may be in either the indoor unit or the outdoor unit, and the indoor heat exchanger is in the indoor unit of the air conditioner.

The present disclosure relates to an air conditioner for cooling indoor space, with the outdoor heat exchanger serving as the condenser and the indoor heat exchanger serving as the evaporator. Hereinafter, for convenience of explanation, the indoor unit including the indoor heat exchanger is referred to as the air conditioner, and the indoor heat exchanger is referred to as the heat exchanger.

FIG. 1 is a view showing an air conditioner 1 according to an embodiment of the present disclosure. FIG. 2 is a view schematically showing a cross-section taken along the line A-A' shown in FIG. 1. FIG. 3 is a view showing another operating state of the air conditioner 1 shown in FIG. 1. FIG. 4 is a view schematically showing a cross-section taken along the line C-C' shown in FIG. 1. FIG. 5 is a view schematically showing a cross-section taken along the line B-B' shown in FIG. 1. FIG. 6 is a view showing a discharge unit body of the air conditioner 1 shown in FIG. 1.

Referring to FIGS. 1 to 6, the air conditioner 1 may include a housing 10 forming an outer appearance, a heat exchanger 20 for exchanging heat with air flowing into the housing 10, a blowing unit 30 to circulate air into or out of the housing 10, and a discharge unit 100 to discharge the air blown from the blowing unit 30 to the outside of the housing 10.

At least one housing opening 11 may be formed in the front surface of the housing 10. The at least one housing opening 11 may be formed to correspond to a shape of a cross-section along a plane parallel to the rotation axis of the discharge unit 100 so that the discharge unit 100 to be described later is rotatably inserted to the housing opening 11. The at least one housing opening 11 may be provided in a substantially rectangular shape. The housing 10 may have an inlet port 12 formed in the rear surface so that outside air is sucked into the housing 10. However, the position where the inlet port 12 is formed is not limited to the rear surface but may be formed on a side surface or the front surface.

Referring to FIGS. 2 to 4, the inlet port 12 is formed on the rear surface of the housing 10 provided at the rear of the heat exchanger 20 to guide the outside air of the housing 10 into the housing 10. Air flowing into the housing 10 through the inlet port 12 absorbs heat or loses heat while passing the heat exchanger 20. The heat-exchanged air through the heat exchanger 20 is discharged to the outside of the housing 10 through the discharge unit 100 by the blowing unit 30.

Referring to FIG. 5, the blowing unit 30 may be located on the air flow path between the inlet port 12 and the discharge unit 100 to suck the outside air into the housing 10, force the air to pass the heat exchanger 20 to exchange heat, and discharge the air to the outside of the housing 10.

The blowing unit 30 may include a blower fan (not shown). The blower fan may include a mixed flow fan, but the blower fan is not limited thereto and may have any configuration that may circulate the air flowing from the outside of the housing 10 to flow back to the outside of the housing 10. For example, the blowing unit 30 may include a cross fan, a turbo fan, and a sirocco fan. There are no limitations on the number of the blowing units 30, and in the present embodiment, at least one blowing unit 30 may be provided to correspond to the at least one discharge unit 100. The blowing unit 30 may be arranged in front of the inlet port 12 and the heat exchanger 20 may be arranged between the blowing unit 30 and the inlet port 12. The discharge unit 100 may be arranged in front of the blowing unit 30. The blowing unit 30 may suck in air through the inlet port 12 behind and blow the air toward the discharge unit 100 in the front.

The blowing unit 30 may be provided with a fan driving part (not shown) to drive the blower fan. The fan driving part (not shown) may include a motor.

The heat exchanger 20 is arranged between the blowing unit 30 and the inlet port 12 to absorb heat from the air flowing in through the inlet port 12 or to transfer heat to the air flowing in through the inlet port 12. The heat exchanger 20 may include a tube (not shown) and a header (not shown) coupled to upper and lower sides of the tube. However, the type of the heat exchanger 20 is not limited.

At least one heat exchanger 20 arranged inside the housing 10 may be provided to correspond to the number of the discharge units 100.

Referring to FIG. 6, the discharge unit 100 is rotatably coupled to the housing 10, and is provided so that the heat-exchanged air in the housing 10 may be discharged to the outside of the housing 10. Specifically, the discharge unit 100 may be rotatably inserted to the housing opening 11 of the housing 10. The discharge unit 100 may have a substantially cylindrical shape, but is not limited thereto and may have the shape of an elliptical column or a column having a polygonal cross-section. Although three discharge units 100 are shown in FIG. 1, the number of the discharge units 100 is not limited thereto, and there may be two or less or four or more discharge units 100. The discharge unit 100 includes a first outlet port 101 and a second outlet port 102 provided to discharge air at different speeds.

The first outlet port 101 may include an opening formed to penetrate the inner and outer surfaces of the discharge unit 100 so that the heat-exchanged air is blown at high speed. The first outlet port 101 is formed in a portion of the outer circumferential surface of the discharge unit 100. Specifically, the first outlet port 101 is formed to have predetermined length L1 along the circumferential direction of the discharge unit 100.

The second outlet port 102 may include a plurality of discharge holes 102*a* formed to penetrate the inner and outer surfaces of the discharge unit 100 so as to blow the heat-exchanged air at low speed. Accordingly, the second outlet port 102 may be formed in a mesh shape. The second outlet port 102 is formed in other portion of the outer circumferential surface than the portion in which the first outlet port 101 of the discharge unit 100 is formed. Specifically, the second outlet port 102 is formed to have predetermined length L2 along the circumferential direction of the discharge unit 100.

With this configuration, the air discharged through the second outlet port 102 may be discharged at a lower speed than the air discharged through the first outlet port 101.

The second outlet port 102 may be formed to have a wider area than the first outlet port 101. That is, the length L2 of the second outlet port 102 may be longer than the length L1 of the first outlet port 101.

The discharge unit 100 may include a discharge unit body 110 having a first outlet port 101 and a second outlet port 102 formed on the outer circumferential surface thereof. The discharge unit body 110 may have a substantially cylindrical shape, but is not limited thereto, and may have the shape of an elliptical column or a column with a polygonal cross-section. The discharge unit body 110 may include an upper plate 111, a lower plate 112, and a circumferential plate 113.

The upper plate 111 and the lower plate 112 are provided in a substantially circular plate, and an upper rotation axis 114*a* and a lower rotation axis 114*b* may be provided on an upper surface 111*a* of the upper plate 111 and a lower surface 112*a* of the lower plate 112, respectively. The upper rotation axis 114*a* and the lower rotation axis 114*b* are rotatably coupled to a discharge unit coupling unit 14 of the housing 10 so that the discharge unit 100 may rotate relative to the housing 10.

A power transmission part 115 receiving rotational power from a discharge unit driving part 120, which will be described later, may be provided below the lower plate 112. The power transmission part 115 may extend down from the lower plate 112 in the vertical direction and may be formed along the outer circumferential direction. The power transmission part 115 may include gear teeth formed along the outer circumference to receive power from the discharge unit driving part 120. The gear teeth may be formed on the entire outer circumferential surface of the power transmission part 115, but is not limited thereto and may be formed in a portion of the outer circumferential surface.

The circumferential plate 113 connects the upper plate 111 and the lower plate 112 and extends in the vertical direction.

The circumferential plate 113 may define the first outlet port 101 and the second outlet port 102. Accordingly, two circumferential plates 113 may be provided. However, the number of the circumferential plates 113 is not limited.

The upper plate 111, the lower plate 112, and the circumferential plate 113 may be integrally formed, but they are not limited thereto and may be formed separately and joined together to form one discharge unit body 110.

The discharge unit body 110 may be provided adjacent to the first outlet port 101 and may include at least one blade 116 to guide the air discharged from the first outlet port 101. Although seven blades 116 are shown in this embodiment, the number of blades 116 is not limited thereto and may be six or less or eight or more. In addition, at least one blade 116 may be provided to be rotated by a blade driving source (not shown) so that the direction of the air discharged from the first outlet port 111 may be changed.

Referring to FIGS. 2, 4 and 5, the discharge unit 100 may include a discharge unit driving part 120 that provides power to rotate the discharge unit body 110. The discharge unit driving part 120 may include a driving source 121 and a power transmitting member 122.

The driving source 121 may include a motor that generates power to rotate the discharge unit body 110. The driving source 121 may be fixed to the housing 10.

The power transmitting member 122 may transmit the power generated by the driving source 121 to the discharge unit body 110. Specifically, the power transmitting member 122 may be a gear, and may engage with the power transmission part 115 of the discharge unit body 110 to transmit power.

In this embodiment, the power transmitting member 122 is arranged to be in gear with the outer circumferential surface of the power transmission part 115, but the present disclosure is not limited thereto and it is possible that the power transmitting member 122 is arranged to be in gear with the inner circumferential surface of the power transmission part 115.

Hereinafter, operation of the air conditioner 1 of the present disclosure will be described.

Referring to FIGS. 1 and 2, the user may set the first outlet port 101 to be located in the housing opening 11 in order to directly receive the high-speed discharge airflow from the air conditioner 1. That is, the discharge unit driving part 120 may rotate the discharge unit body 110 such that the first outlet port 101 is located at the housing opening 11.

Accordingly, air flowing into the housing 10 through the inlet port 12 passes the heat exchanger 20 and the blowing unit 30 in sequence, and flows into the interior of the discharge unit body 110 through the second outlet port 102. The air flow direction of the air flowing into the interior of the discharge unit body 110 is guided by at least one blade 116 and the air is discharged to the outside of the housing 10 through the first outlet port 101. In this case, since the first outlet port 101 is formed as one opening, the air conditioner 1 may perform intensive air conditioning.

On the other hand, referring to FIGS. 3 and 4, the user may set the second outlet port 102 to be located in the housing opening 11 in order to receive a low speed discharge airflow from the air conditioner 1. That is, the discharge unit driving part 120 may rotate the discharge unit body 110 such that the second outlet port 102 is positioned at the housing opening 11.

Accordingly, the air flowing into the housing 10 through the inlet port 12 passes the heat exchanger 20 and the blowing unit 30 in sequence, and flows into the interior of the discharge unit body 110 through the first outlet port 101. The air flowing into the discharge unit body 110 is discharged to the outside of the housing 10 through the plurality of discharge holes 102*a* of the second outlet port 102. At this time, since the plurality of discharge holes 102*a* are each formed as an opening having a very small area, the air velocity of the discharged air is reduced, and a low-speed discharge airflow may be provided to the user. That is, the air conditioner 1 may slowly air-condition the entire room. With this configuration, the air conditioner 1 may cool or heat the room at the wind speed at which the user feels pleasant.

Hereinafter, an air conditioner according to another embodiment will be described.

The description of the same configurations as those described above will be omitted.

FIG. 7 is a view showing an air conditioner 2 according to another embodiment of the present disclosure. FIG. 8 is a view schematically showing a cross-section taken along the line D-D' shown in FIG. 7. FIGS. 9 and 10 are a view showing a discharge unit body 210 of the air conditioner 2 shown in FIG. 7. FIG. 11 is a view schematically showing a cross-section taken along the line E-E' shown in FIG. 7. FIG. 12 is a view showing another operating state of the air conditioner 2 shown in FIG. 7. FIG. 13 is a view schematically showing a cross-section taken along the line F-F' shown in FIG. 12. FIG. 14 is a view showing another operating state of the air conditioner 2 shown in FIG. 7. FIG. 15 is a view schematically showing a cross-section taken along the line G-G' shown in FIG. 14.

The air conditioner 2 according to the present embodiment may include a discharge unit 200. However, as described above, there is no limitation on the number of the discharge units 200, and hereinafter, it is assumed that one discharge unit 200 is provided for convenience of explanation.

The air conditioner 2 according to the present embodiment may have one housing opening 11*a* formed in the housing 10*a* as one discharge unit 200 is provided.

Unlike the embodiment shown in FIG. 1, the air conditioner 2 according to the present embodiment may be provided with an inlet port 12*a* arranged on the lower rear side of the housing 10*a*. Accordingly, the blowing unit 50 may be arranged at the lower end of the inside of the housing 10*a* to suck the outside air into the housing 10*a* through the inlet port 12*a*.

The blowing unit 50 is arranged in front of the inlet port 12*a* provided on the lower rear side of the housing 10*a* and sucks the outside air of the housing 10*a* in to the housing 10*a* through the inlet port 12*a*. The blowing unit 50 is configured to blow the air sucked into the housing 10*a* toward the discharge unit 200 arranged on the upper side. Accordingly, the blowing unit 50 may include a centrifugal fan capable of sucking in air in the direction of the rotational axis and discharging it in the radial direction.

A heat exchanger 40 is arranged on the air flow path between the blowing unit 50 and the inlet port 12*a* and may absorb heat from the air sucked in through the inlet port 12*a* or transfer heat to the air sucked in through the inlet port 12*a*. Alternatively, the heat exchanger 40 may be arranged in the air flow path between the blowing unit 50 and the discharge unit 200. That is, the heat exchanger 40 may be arranged at any point in the air flow path between the inlet port 12*a* and the housing opening 11*a*.

The discharge unit 200 of the air conditioner 2 is rotatably coupled to a discharge unit coupling portion 14*a* of the housing 10*a* and is provided so that the heat-exchanged air inside the housing 10*a* is discharged to the outside of the housing 10*a*. The discharge unit 200 may have a substantially cylindrical shape, but is not limited thereto and may have the shape of an elliptical column or a column having a polygonal cross-section. The discharge unit 200 includes a first outlet port 201, a second outlet port 202, a discharge unit opening 203 and a blocking portion 204.

The first outlet port 201 may include an opening formed to penetrate the inner and outer surfaces along the radial direction of the discharge unit 200 so that the heat-exchanged air is blown at high speed. The first outlet port 201 may be formed in a portion of the outer circumference of the discharge unit 200. The first outlet port 201 is formed to have predetermined length L3 along the outer circumferential direction of the discharge unit 200.

The second outlet port 202 may include a plurality of discharge holes 202*a* formed to penetrate the inner and outer surfaces along the radial direction of the discharge unit 200 so as to blow the heat-exchanged air at low speed. That is, the second outlet port 202 may be formed in a mesh shape. The second outlet port 202 may be formed in other portion than the first outlet port 201 formed on the outer circumference of the discharge unit 200. The second outlet port 202 is formed to have predetermined length L4 along the outer circumferential direction of the discharge unit 200.

The discharge unit opening 203 may include an opening formed so as to penetrate the inner and outer surfaces of the discharge unit 200 along the direction of the rotation axis of the discharge unit 200 so that the heat exchanged air may flow into the discharge unit 200. The discharge unit opening 203 may be provided on the lower side of the discharge unit 200.

The blocking portion 204 may be formed in other portion than the portions where the first outlet port 201 and the second outlet port 202 are formed on the outer circumference of the discharge unit 200 so as to block the housing opening 11*a* of the air conditioner 2 when the air conditioner 2 is not in use. The blocking portion 204 is formed to have predetermined length L5 along the circumferential direction of the discharge unit 200.

The second outlet port 202 may be formed to have a larger area than the first outlet port 201. That is, the length L4 of the second outlet port 202 may be longer than the length L3 of the first outlet port 201.

In addition, the blocking portion 204 may be formed to have a wider area than the first outlet port 201 and/or the second outlet port 202. That is, the length L5 of the blocking portion 204 may be longer than the length L3 of the first outlet port 201 and/or the length L4 of the second outlet port 202.

The discharge unit 200 may have a first outlet port 101, a second outlet port 202, and a blocking portion 204 formed on the outer circumferential surface thereof and may include a discharge unit body 210 having a discharge unit opening 203 formed on the lower side. The discharge unit body 210 may include an upper plate 211, a lower plate 212, and a circumferential plate 213.

The upper plate 211 is provided with an approximately circular plate and the upper surface 211*a* of the upper plate 211 is provided with an upper rotation axis 214*a*. The upper rotation axis 214*a* may be rotatably coupled to the discharge unit coupling portion 14*a* of the housing 10*a*.

The lower plate 212 may include a discharge unit opening 203 through which the air blown from the blowing unit 50 arranged on the lower side flows into the interior of the discharge unit body 210. The lower plate 212 may have a donut shape, in which a substantially circular discharge unit opening 203 is formed. The discharge unit opening 203 may be formed on a plane perpendicular to the direction of the rotation axis of the discharge unit 200.

The lower plate 212 may be provided with a power transmission part 215 receiving rotational power from the discharge unit driving part 220.

The power transmission part 215 provided at the lower part of the lower plate 212 includes a lower rotation axis 214*b* provided at the rotation center and the lower rotation axis 214*b* may be supported by a support member 212*a* radially extending toward the circumferential plate 213. Although FIG. 9 and FIG. 10 show four support members 212*a*, the number of the support members 212*a* is not limited thereto. However, it is preferable to determine the number of the support members 212*a* within a range that does not prevent the air blown from the lower side from flowing into the discharge unit body 210. With this configuration, the power transmission part 215 may have an opening 215*a* formed between the support members 212*a*.

The lower rotation axis 214*b* may be rotatably coupled to the discharge unit coupling portion 14*a*.

The housing 10*a* may further include a blocking rib 15*a* at the lower end of the housing opening 11*a* to close the discharge unit opening 203 in order to prevent the discharge unit opening 203 formed in the lower plate 212 from linking to the outside of the housing 10*a*. The blocking rib 15*a* may extend toward the outside of the housing 10*a*.

The circumferential plate 213 may define a first outlet port 201 and a second outlet port 202. Therefore, two circumferential plates 213 may be provided. However, the number of the circumferential plates 213 is not limited. Here, at least one circumferential plate 213 may be the blocking portion 204.

The discharge unit body 210 may include at least one blade 216 provided adjacent to the first outlet port 201 for guiding air discharged from the first outlet port 201.

The discharge unit 200 may include a discharge unit driving part 220 that provides power to rotate the discharge unit body 210. The discharge unit driving part 220 may include a driving source 221 and a power transmitting member 222.

The driving source 221 may include a motor for generating power to rotate the discharge unit body 210.

The power transmitting member 222 may be engaged with the power transmission part 215 of the discharge unit body 210 to deliver the power generated by the driving source 221 to the discharge unit body 210.

Hereinafter, operation of the air conditioner 2 of the present disclosure will be described.

Referring to FIG. 11, the user may set the first outlet port 201 to be located in the housing opening 11*a* in order to directly receive the high-speed discharge airflow from the air conditioner 2.

Accordingly, the air flowing into the housing 10*a* through the inlet port 12*a* passes the heat exchanger 20 and the blowing unit 30 sequentially and then flows into the discharge unit 200 placed at the top. At this time, most of the heat-exchanged air flows into the discharge unit body 210 through the discharge unit opening 203 provided in the lower plate 212. The direction of a flow of the air flowing into the discharge unit body 210 is guided by at least one blade 216 and the air is discharged to the outside of the housing 10 through the first outlet port 201. According to this, the heat-exchanged air may be discharged while keeping the speed at which the blowing unit 30 blows the air. That is, the air conditioner 2 may perform intensive air conditioning.

On the other hand, referring to FIGS. 12 and 13, the user may set the second outlet port 202 to be located in the housing opening 11*a* in order to receive a low-speed discharge airflow from the air conditioner 2.

Accordingly, the air flowing into the housing 10*a* through the inlet port 12*a* passes the heat exchanger 20 and the blowing unit 30 sequentially and flows into the interior of the discharge unit 200 placed at the top. At this time, most of the heat-exchanged air flows into the discharge unit body 210 through the discharge unit opening 203 provided in the lower plate 212. The air flowing into the discharge unit body 210 is discharged to the outside of the housing 10*a* at a reduced air velocity through the plurality of discharge holes 202*a* of the second outlet port 202. That is, the air conditioner 2 may cool or heat the room with the wind speed at which the user feels pleasant.

On the other hand, referring to FIGS. 14 and 15, the user may set the blocking portion 204 to be located at the housing opening 11*a* when the air conditioner 2 is not used. Accordingly, the air conditioner 2 may shut its interior from the outside.

The air conditioner 2 according to the present embodiment may prevent the wind speed from being reduced when the heat-exchanged air flows into the discharge unit body 210 by providing a separate discharge unit opening 203 on the lower surface of the discharge unit 200. Therefore, the air conditioner 2 may provide high-speed, concentrated airflows. In addition, when the air conditioner 2 is not used, the blocking portion 204 closes the housing opening 11*a*, so that foreign matters may be prevented from entering the inside of the air conditioner 2.

Hereinafter, an air conditioner 3 according to still another embodiment will be described.

The description of the same configuration as those described above will be omitted.

FIG. 16 is a cross-sectional view showing the air conditioner 3 according to still another embodiment of the present disclosure. FIG. 17 is a view showing a discharge unit body 310 of the air conditioner 3 shown in FIG. 16.

The air conditioner 3 according to the present embodiment is provided with an inlet port 12*b* on the lower rear side of the housing 10*b*. Also, the heat exchanger 40 and the blowing unit 50 are arranged below the discharge unit 300.

Specifically, the blowing unit 50 is arranged in front of an inlet port 12*b* provided on the lower rear side of the housing 10*b* and sucks the outside air of the housing 10*b* into the housing 10*b* through an inlet port 12*b*. The blowing unit 50 is configured to blow the air sucked into the housing 10*b* toward the discharge unit 300 arranged on the upper side. Accordingly, the blowing unit 50 may include a centrifugal fan capable of sucking in air in the direction of the rotational axis and discharging it in the radial direction.

The heat exchanger 40 is arranged on an air flow path between the blowing unit 50 and the inlet port 12*b* and may absorb heat from the incoming air through the inlet port 12*b* or transfer the heat to the incoming air through the inlet port 12*b*. On the other hand, the heat exchanger 40 may be arranged on an air flow path between the blowing unit 50 and the discharge unit 300. That is, the heat exchanger 40 may be arranged on the air flow path between the inlet port 12*b* and the housing opening 11*b*.

Referring to FIG. 17, the discharge unit 300 is rotatably coupled to the housing 10*b* so that the heat-exchanged air inside the housing 10*b* is discharged to the outside of the housing 10*b*. The discharge unit 300 may have a cylindrical shape with the bottom opened. The discharge unit 300 includes a first outlet port 301 and a second outlet port 302. The second outlet port 302 includes a plurality of discharge holes 302*a*.

The discharge unit 300 may include a discharge unit body 310 having a first outlet port 301 and a second outlet port 302 formed on the outer circumferential surface thereof. The discharge unit body 310 may include an upper plate 311, a lower plate 312, and a circumferential plate 313.

The upper plate 311 is provided as a substantially circular plate and the upper surface 311*a* of the upper plate 311 is provided with an upper rotation axis 314*a*. The upper rotation axis 314*a* may be rotatably coupled to a discharge unit coupling portion 14*b* of the housing 10*b*.

The lower plate 312 may include a discharge unit opening 303 through which the air blown from the blowing unit 50 arranged at the lower side flows into the interior of the discharge unit body 310. The lower plate 312 may have a donut shape in which a substantially circular discharge unit opening 303 is formed. The discharge unit opening 303 may be formed on a plane perpendicular to the rotation axis direction of the discharge unit 300.

The power transmission part 315 provided at the lower part of the lower plate 312 includes a lower rotation axis 314*b* provided at the center of rotation and the lower rotation axis 314 may be supported by a support member 312*a* radially extending toward the circumferential plate 313. Although four support members 312*a* are shown in FIG. 17, the number of the support members 312*a* is not limited thereto. However, it is preferable to determine the number of the support members 312*a* within a range that does not obstruct the inflow of the air blown from the lower side into the interior of the discharge unit body 310. With this configuration, the power transmission part 315 may have an opening formed between the support members 312*a*.

The lower rotation axis 314*b* may be rotatably coupled to the discharge unit coupling portion 14*b*.

The housing 10*b* may further include a blocking rib 15*b* at the lower end of the housing opening 11*b*, capable of closing the discharge unit opening 303 to prevent the discharge unit opening 303 formed in the lower plate 312 from linking to the outside of the housing 10*b*. The blocking rib 15*b* may extend toward the outside of the housing 10*b*.

Hereinafter, an air conditioner 4 according to still another embodiment will be described.

The description of the same configuration as described above description will be omitted.

FIG. 18 is a cross-sectional view showing the air conditioner 4 according to still another embodiment of the present disclosure.

The air conditioner 4 according to the present embodiment may be provided with an inlet port 12*c* on the lower front side of the housing 10*c*. Accordingly, the heat exchanger 60 and the blowing unit 70 may be provided on the lower side of the discharge unit 100. The discharge unit 100 may be rotatably coupled to the discharge unit coupling portion 14*c* of the housing 10*c*.

Specifically, the blowing unit 70 is arranged behind the inlet port 12*c* provided on the lower front side of the housing 10*c* and sucks the outside air of the housing 10*c* into the housing 10*c* through the inlet port 12*c*. The blowing unit 70 is configured to blow the air sucked into the housing 10*c* toward the discharge unit 100 arranged on the upper side. Accordingly, the blowing unit 70 may include a centrifugal fan capable of sucking in air in the direction of the rotational axis and discharging it in the radial direction.

The heat exchanger 60 is arranged between the blowing unit 70 and the discharge unit 100 and may absorb heat from the air that has passed the blowing unit 70 or may transfer heat to air that has passed the blowing unit 70. On the other hand, the heat exchanger 60 may be arranged between the blowing unit 70 and the inlet port 12*c*. That is, the heat exchanger 60 may be located at any point on the air flow path between the inlet port 12*c* and the housing opening 11*c*.

As described above, since the air conditioner 1, 2, 3, 4 according to the present disclosure may change the speed of the air discharged by rotating the discharge unit 100, 200, 300, various discharge airflows may be provided with a relatively simple structure.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. An air conditioner comprising:

a housing having an inlet port and having an opening;

a heat exchanger configured to exchange heat with air sucked in through the inlet port;

a blower configured to circulate air into or out of the housing; and a discharge unit having an outer circumferential surface and configured to be rotatable relative to the housing, the discharge unit having a first outlet port formed in a portion of the outer circumferential surface to discharge the heat-exchanged air and a second outlet port formed in another portion of the outer circumferential surface to discharge the heat-exchanged air at different speed from the air discharged from the first outlet port, the discharge unit being rotatable to a first position at which the first outlet port is aligned to discharge air through the housing opening, and being rotatable to a second position at which the second outlet port is aligned to discharge air through the housing opening.

2. The air conditioner of claim 1, wherein the discharge unit selectively discharges air through the first outlet port or the second outlet port as the discharge unit rotates relative to the housing.

3. The air conditioner of claim 1, wherein the first outlet port and the second outlet port are each formed to have a predetermined length along an outer circumferential direction of the discharge unit.

4. The air conditioner of claim 1, wherein the second outlet port is formed to have longer length than the length of the first outlet port along the outer circumferential direction.

5. The air conditioner of claim 1, wherein the second outlet port comprises a plurality of discharge holes.

6. The air conditioner of claim 1, wherein the discharge unit is configured such that heat-exchanged air flows into the first outlet port and is discharged to the second outlet port, or heat-exchanged air flows into the second outlet port and is discharge to the first outlet port.

7. The air conditioner of claim 1, wherein the discharge unit comprises a discharge unit opening formed on a surface perpendicular to a rotation axis so that heat-exchanged air flows in the direction of the rotation axis.

8. The air conditioner of claim 1, wherein the discharge unit is configured to force air to flow in the direction of a rotational axis and discharge in a radial direction.

9. The air conditioner of claim 1, wherein the second outlet port is configured to discharge air at a speed lower than the air discharged from the first outlet port.

10. The air conditioner of claim 1, wherein the discharge unit comprises at least one blade arranged adjacent to the first outlet port.

11. The air conditioner of claim 1, further comprising a discharge unit driving part to rotate the discharge unit.

12. The air conditioner of claim 11, wherein the discharge unit driving part comprises a motor.

13. The air conditioner of claim 1, wherein the discharge unit is provided in the plural.

14. The air conditioner of claim 1, wherein the blower is arranged behind the discharge unit and is configured to blow air flowing into the housing to a front side where the discharge unit is located.

15. The air conditioner of claim 1, wherein the blower is arranged below the discharge unit and is configured to blow air flowing into the housing to an upper side where the discharge unit is located.

* * * * *